US007034796B2

(12) United States Patent
Nitawaki

(10) Patent No.: US 7,034,796 B2
(45) Date of Patent: Apr. 25, 2006

(54) DISPLAY CONTROL CIRCUIT FOR LIQUID CRYSTAL DISPLAY

(75) Inventor: Shouji Nitawaki, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 522 days.

(21) Appl. No.: 10/320,577

(22) Filed: Dec. 17, 2002

(65) Prior Publication Data

US 2003/0189544 A1 Oct. 9, 2003

(30) Foreign Application Priority Data

Apr. 9, 2002 (JP) ..... 2002-106416

(51) Int. Cl.
*G09G 3/00* (2006.01)

(52) U.S. Cl. ..... 345/99; 345/213; 345/98

(58) Field of Classification Search ..... 345/98, 345/99, 213

See application file for complete search history.

(56) References Cited

U.S. PATENT DOCUMENTS 4,649,383 A 3/1987 Takeda et al.
6,011,535 A * 1/2000 Katoh et al. ..... 345/98
6,091,387 A 7/2000 Ueno et al.
6,147,668 A * 11/2000 Eglit ..... 345/99
6,452,592 B1 * 9/2002 Zhang et al. ..... 345/213

FOREIGN PATENT DOCUMENTS

| | | |
|---|---|---|
| JP | 2-7444 | 2/1990 |
| JP | 9-5775 | 1/1997 |
| JP | 9-62231 | 3/1997 |
| JP | 10-111670 | 4/1998 |

* cited by examiner

*Primary Examiner*—Richard Hjerpe
*Assistant Examiner*—Tammy Pham
(74) *Attorney, Agent, or Firm*—Wenderoth, Lind & Ponack, L.L.P.

(57) ABSTRACT

When count values CNT of a counter 11 are values other than 1, a selection signal SEL of a decode section 18 becomes "H", so that a clock signal CLK is selected by a selection section 17 and it is inputted into the counter 11 and a shift section 15 as a display clock signal DCK. When the count value CNT becomes 1, the selection signal SEL becomes "L", so that a clock signal CLK divided into ½ by a division section 16 is selected in the selection section 17 and outputted as the display clock signal DCK. Thereby, the count value CNT is maintained to be 1 for two cycles of the clock signal CLK. Thereby, the pulse width of a common signal C1 outputted from the shift section 15 becomes two times the pulse width of the other common signals C2 to C33. Therefore, large pixels driven on the basis of the common signal C1 can be displayed with the same contrast.

20 Claims, 11 Drawing Sheets

10C
SHIFT SECTION
C
R
C1
C2
C33
FLM
14
12
15
RESET SECTION
13
COUNTER
Q6
Q1
R
C
11
DCK
CNT
18
DECODE SECTION
SEL
21
SELECTION SECTION
24
SELECTION SECTION
$24_x$
$24_1$
$24_4$
23
DECODE SECTION
0
3 4 5 6 7
CNT3
19
COUNTER
Q3
Q1
22
RESET SECTION
X ON
X4
X3
X2
X1
CLK
RST

X ON
25
CX1
CX2
COINCIDENCE DETECTION SECTION
25x
25₁
25₂
CNT3
19
Q1
Q3
COUNTER
R
C
20a
CLK
22
RESET SECTION
RST
18
DECODE SECTION
CNT
SEL
21
SELECTION SECTION
DCK
11
Q1
Q6
COUNTER
R
C
12
13
RESET SECTION
14
FLM
SHIFT SECTION
I
C
R
C1
C2
C33
15
10D

X ON1
X ON0
CX1
CX2
CNT3
19
CLK
RST
COINCIDENCE DETECTION SECTION
25
20a
Q3
COUNTER
R
Q1
C
RESET SECTION
22
DECODE SECTION
26
26a
26b
26c
SEL
SELECTION SECTION
21
CNT
DCK
Q6
COUNTER
R
Q1
C
11
2
13
RESET SECTION
14
FLM
SHIFT SECTION
I
C
R
15
C1
C2
C33
10E

DISPLAY CONTROL CIRCUIT FOR LIQUID CRYSTAL DISPLAY

BACKGROUND OF THE INVENTION

The present invention relates to a display control circuit for an LCD (liquid crystal display).

DESCRIPTION OF THE RELATED ART

FIG. 2 is a configuration diagram showing one example of a conventional liquid crystal display.

The liquid crystal display has an LCD 1 with a dot array of pixels arranged in a 2-dimentional matrix shape. The LCD 1 has 33 common electrodes arranged in parallel and n segment electrodes perpendicular to the common electrodes such that liquid crystal is positioned between the common electrodes and the segment electrodes. When the liquid crystal is applied with a voltage, its molecule orientations are aligned so that light transmittance or light reflectance varies. The LCD 1 is constituted such that any image is dot-displayed utilizing such a characteristic of liquid crystal.

The liquid crystal display has a display memory 2 storing image information with 33 rows×n columns for displaying on the LCD 1. Then, data output terminals D1 to Dn of the display memory 2 are connected to an input of a data latch 3. The data latch 3 saves data input in the input and outputs the same at a timing of rising of a display clock signal DCK. Then, the output of the data latch 3 is connected to an input of a segment driver 4. The segment driver 4 converts the given image information to a voltage for display corresponding to the LCD 1 to drive segment electrodes of the LCD 1.

Further, this liquid crystal display is provided with a display control circuit 10 which sequentially scans image information in the display memory 2 to read out it and which displays the read image information at a predetermined position of the LCD 1.

The display control circuit 10 is provided with a 6-bit counter 11 operating when the display clock signal DCK falls a level "H" to a level "L", whose count values CNT are applied to address terminals A1 to A6 of the display memory 2 as an address signal. Also, an AND (AND gate) 12 which outputs "H" when the count value CNT has reached 33 is connected to output terminals Q1 to Q6 of the counter 11.

The output of the AND 12 is connected to a set terminal of a reset section 13 constituted by an SR type FF (flip-flop) 13*a* and an OR (OR gate) 13*b*. The display clock signal DCK is input into the reset terminal of the FF 13*a*. An output of the FF 13*a* is connected to one of inputs of the OR 13*b*, and a reset signal RST is input to the other of inputs of the OR 13*b*. An output of the OR 13*b* is connected to a reset terminal R of the counter 11.

Further, an input of a NOR (NOR gate) 14 which outputs a frame signal FLM of "H" when the count value CNT has become 0 is connected to output terminals Q1 to Q6 of the counter 11, and an output of the NOR 14 is connected to an input terminal I of a shift section 15. The shift section 15 is constituted by a shift register with 33 stages, where data pieces inputted from the input terminal I at a time of rising of the clock signal DCK are sequentially shifted to the downstream stage one bit by one bit and held. Held data of each stage of the shift section 15 is outputted as common signals C1, C2, . . . , C33 to be input in a common driver 5. The common driver 5 converts the input common signals C1 to C33 to voltages for display corresponding to the LCD 1 to drive the common electrodes of the LCD 1.

Next, the operation of the liquid crystal display will be explained.

First, the counter 11 is reset by a reset signal RST, so that the count value CTN becomes 0. Thereby, a frame signal FLM outputted from the NOR 14 becomes "H". Also, data in address 0 in the display memory 2 is read out and inputted into the data latch 3.

After the reset signal RST is released, when a display clock signal DCK rises, the frame signal FLM is held in the shift section 15, and a common signal C1 becomes "H". The common signal C1 is input into the common driver 5 and the common electrode of the first row in the LCD 1 is driven. On the other hand, the data of address 0 read out from the display memory 2 is held in the data latch 3, and the segment electrodes in the LCD 1 are driven via the segment driver 4. Thereby, the first row of the LCD 1 is displayed according to the data of address 0 in the display memory 2.

Next, when a display clock signal DCK rises, the count value CNT of the counter 11 becomes 1. Thereby, the frame signal FLM outputted from the NOR 14 becomes "L", and data of address 1 in the display memory 2 is read out and input into the data latch 3. Then, when a clock signal CLK rises, the frame signal FLM is sequentially shifted to the shift section 15 and held, so that the common signals C1, C2 become "L", "H", respectively. The common signal C2 is input into the common driver 5, and the common electrode of the second row in the LCD 1 is driven. On the other hand, the data of address 1 read out from the display memory 2 is held in the data latch 3, and the segment electrodes in the LCD 1 are driven via the segment driver 4. Thereby, the second row of the LCD 1 is displayed according to the data of address 1 in the display memory 2.

As described above, the count value CNT becomes i at a time of i-th rising of the display clock signal DCK and data of address i in the display memory 2 is read out. Then, at a time of rising of the next display clock signal DCK, the common signal Ci+1 becomes "H" and the read data of address i is outputted to the segment electrodes in the LCD 1. Thereby, the i+1 row of the LCD 1 is displayed according to the data of address i of the display memory 2.

When the count value CNT becomes 33 at a time of the 33-th rising of the display clock signal DCK, the output signal of the AND 12 becomes "H" and the counter 11 is reset via the reset section 13. Thereby, the count value CNT of the counter 11 becomes 0 immediately.

According to such a repetition, data pieces of address 0 to address 32 in the display memory 2 are sequentially read out in synchronism with the display clock signals DCK and they are displayed in the first to 33-th rows of the LCD 1, respectively. Accordingly, in the liquid crystal display of such a matrix type, any pattern can be displayed by storing the image information of 33 rows×n columns in the display memory 2 as data of dot pattern.

In the conventional liquid crystal display, however, there are the following problems.

That is, since the respective common electrodes are sequentially driven according to display clock signals DCK, the display times of the respective rows are the same. Therefore, in case that the sizes of pixels in the respective rows are equal and loads thereof are equal, a uniform display can be achieved. However, for example, in such a case that large size pixels are arranged in a specific row and a special pattern other than characters is displayed, there is a problem that a load varies according to a difference in pixel size and a difference occurs in contrast of display. This is due to that a capacitance of a liquid crystal varies according to the size of a pixel so that a time elapsed until an applied voltage reaches a predetermined display voltage varies.

SUMMARY OF THE INVENTION

The present invention is to solve the problem in the conventional art and provide a display control circuit for an LCD with a small difference in display contrast.

In order to solve the above-described problem, a representative display control circuit for an LCD of the present invention which comprises a plurality of common electrodes and a plurality of segment electrodes arranged so as to cross the common electrodes, for performing displaying according to common signals applied to the common electrodes and signals applied to the segment electrodes, is constituted as follows:

That is, the display control circuit comprises: dividing circuit which divides a clock signal of a constant cycle to generate a divided clock signal; selecting circuit which selects one of the clock signal and the divided clock signal according to a selection signal to output the selected one as a display clock signal; counting circuit which counts the number of pulses of the display clock signal to output count values in a predetermined range sequentially and repeatedly; decoding circuit which outputs a selection signal for causing the selecting circuit to select the divided clock signal when the count value has reached a preset value; and common signal generating circuit which generates common signals to sequentially drive common electrodes according to the display clock signal.

The clock signal and the divided clock signal obtained by dividing the clock signal by the dividing circuit are input into the selecting circuit and the clock signal, for example, is selected on the basis of the selection signal to be outputted as a display clock signal. The display clock signals are counted by the counting circuit and the count value is inputted into the decoding circuit. When the count value reaches the preset value, the decoding circuit outputs a selection signal for selecting the divided clock signal.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS (First Embodiment)

Figure 1:
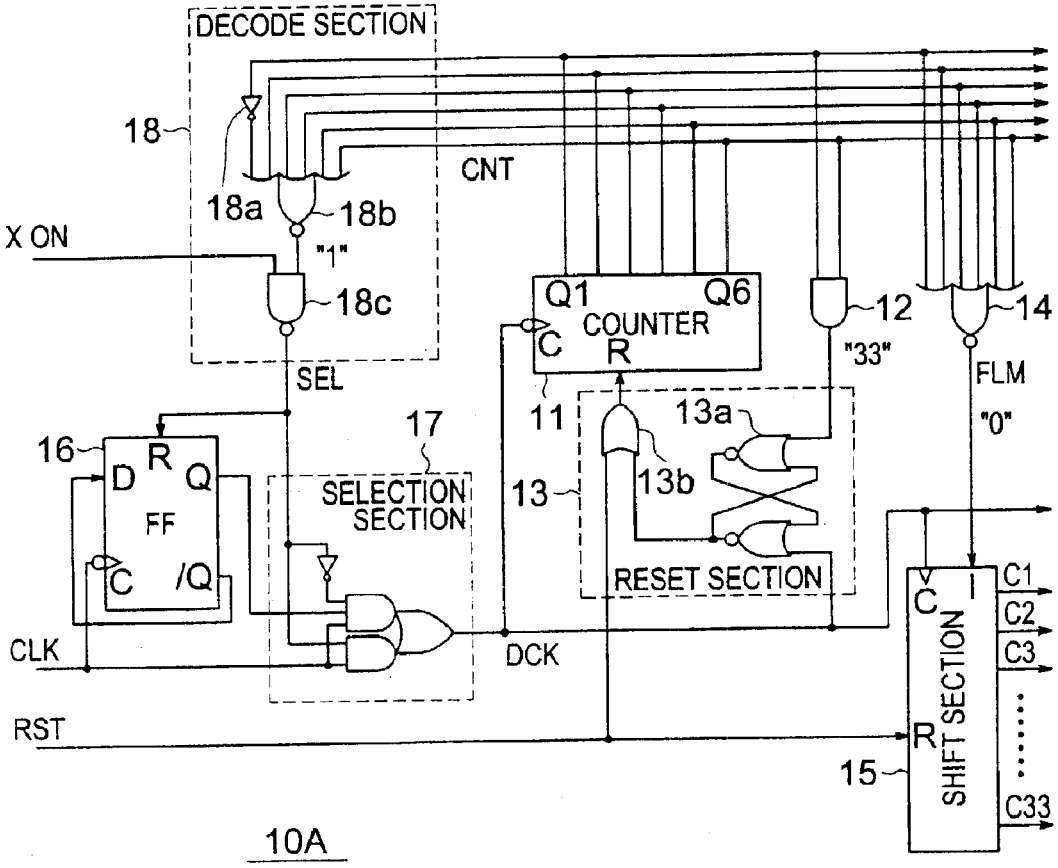
FIG. 1 is a configuration diagram of a liquid crystal display control circuit showing a first embodiment of the present invention.

FIG. 1 is a configuration diagram of a liquid crystal display control circuit showing a first embodiment of the present invention.

Figure 2:
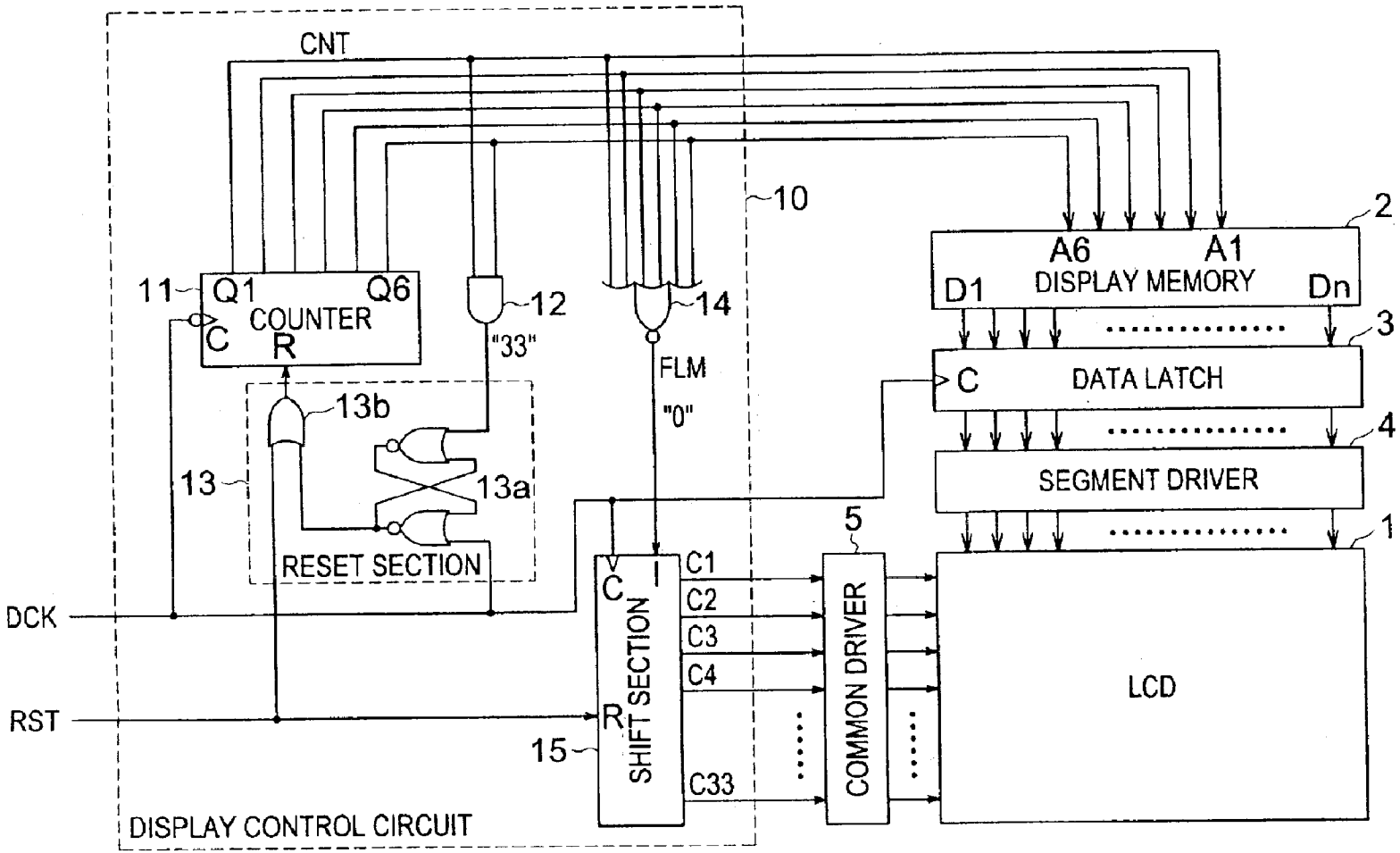
FIG. 2 is a configuration diagram showing one example of a conventional liquid crystal display.

A liquid crystal display control circuit 10A is provided in place of the display control circuit 10 in the liquid crystal display of FIG. 2, where common elements or parts to the elements in FIG. 2 are denoted by common reference numerals.

The liquid crystal display control circuit 10A is provided with a 6-bit binary counter 11 operating at a timing of falling of a display clock signal DCK like the display control circuit 10 in FIG. 2. Count values CNT of the counter 11 are inputted to address terminals A1 to A6 of a display memory 2 as address signal. An AND 12 which outputs "H" when the count value CNT has reached 33 is connected to output terminals Q1 to Q6 of the counter 11.

An output of the AND 12 is connected to a reset section 13. The reset section 13 is constituted by an SR type FF 13*a* and an OR with two inputs 13*b*. An output of the AND 12 is connected to a set terminal of the FF 13*a*. A display clock signal DCK is inputted into a reset terminal of the FF 13*a*. An output of the FF 13*a* is connected to one of inputs of an OR 13*b*, and a reset signal RST is inputted to the other of inputs of the OR 13*b*. An output of the OR 13*b* is connected to a reset terminal R of the counter 11.

A NOR 14 which outputs a frame signal FLM which is changed to "H" when the count value CNT has become 0 is connected to the output terminals Q1 to Q6 of the counter 11, and an output of the NOR 14 is connected to an input terminal I of a shift section 15. The shift section 15 is constituted by a shift register with 33 stages which shifts data applied to the input terminal I sequentially to one bit by one bit to the downstream stages at a timing of rising of the display clock signal DCK and holds it. Held data pieces in the respective stages of the shift section 15 are outputted as common signals C1, C2, . . . , C33 to be applied to a common driver 5.

This liquid crystal display control circuit 10A is further provided with a division section 16, a selection section 17 and a decode section 18. The division section 16 has a configuration that an inverse output terminal/Q of the D-type FF is connected to an input terminal D thereof, and it divides a clock signal CLK applied to a clock terminal C to ½. The selection section 17 selects one of a signal outputted from an output terminal Q of the division section 16 and the clock signal CLK according to a selection signal SEL to output it as a display clock signal DCK. In the selection section 17, the clock signal CLK is selected when the selection signal SEL is "H", while the output signal of the division section 16 is selected when the selection signal SEL is "L".

The decode section 18 outputs a selection signal SEL of "L" when an operation control signal XON is "H" and the count value CNT is 1. The decode section 18 is constituted by a NOR 18*b* implementing an OR operation of the lowermost bit of the count value CNT inverted by an inverter 18*a* of the other bits and a NAND (NAND gate) 18*c* applied with an output signal of the NOR 18*b* and the operation control signal XON. Then, the selection signal SEL is outputted from an output of the NAND 18*c* to be inputted to the selection section 17 and the reset terminal R of the division section 16.

Figure 3:
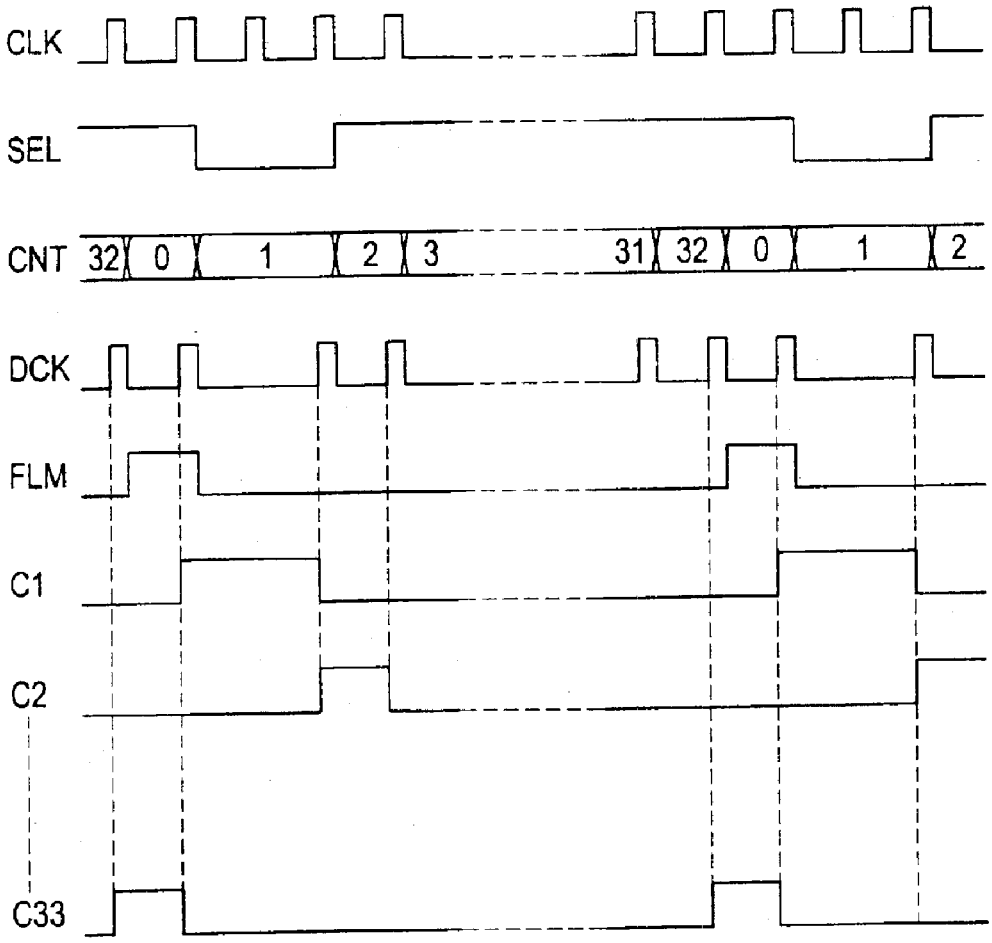
FIG. 3 is a signal waveform diagram showing an operation timing in FIG. 1.

FIG. 3 is a signal waveform diagram showing an operation timing in FIG. 1. An operation shown in FIG. 1 will be explained below with reference to FIG. 3. Here, it is assumed that the operation control signal XON has been set to "H".

As shown in FIG. 3, when the count value CNT of the counter 11 is 32, the selection signal SEL outputted from the decode section 18 becomes "H", so that the clock signal CLK is selected in the selection section 17 and outputted as the display clock signal DCK.

Here, when the display clock signal DCK falls, after the count value CNT of the counter 11 has reached 33 instantaneously, the counter 11 is immediately reset to 0 according to an resetting operation effected by the AND 12 and the reset section 13. Then, the frame signal FLM outputted from the NOR 14 is changed to "H".

Next, when the display clock signal DCK rises, a frame signal FLM is shifted and held in the shift section 15, so that the common signal C1 is changed to "H". Thereafter, when the display clock signal DCK falls, the count value CNT becomes 1, so that the frame signal FLM is changed to "L" and the selection signal SEL of the decode section 18 becomes "L". Then, an output signal of the division section 16 is selected by the selection section 17.

Thereby, the clock signal CLK is divided to ½ to be outputted as a display clock signal DCK. That is, the cycle of the display clock signal DCK becomes two times the cycle of the clock signal CLK. When the display clock signal DCK rises, the frame signal FLM is shifted and held in the shift section 15, and the common signal C1 becomes "L" and the common signal C2 becomes "H". Therefore, the term where the common signal C1 is kept in "H" becomes equal to two cycles of the clock signal CLK.

Thereafter, when the display clock signal DCK rises, the count value CNT becomes 2 and the selection signal SEL becomes "H", so that the common signal C3 becomes "H". In the selection section 17, the clock signal CLK is selected and outputted as the display clock signal DCK.

Next, when the display clock signal DCK rises, the frame signal FLM is shifted sequentially in the shift section 15 and held, and the common signal C2 becomes "L" and the common signal C3 becomes "H". Therefore, the term in which the common signal C2 is maintained in "H" corresponds to one cycle of the clock signal CLK.

Like the above, the count value CNT becomes i at a time of i-th falling of the display clock signal DCK, and the common signal Ci+1 becomes "H" at a time of rising of the next display clock signal DCK.

When the count value CNT becomes 33 at a time of 33-th falling of the display clock signal DCK, the count value CNT is immediately reset to 0 according to a reset operation effected by the AND 12 and the reset section 13.

Incidentally, in the liquid crystal display, the count value CNT is provided as the address signal of the display memory 2, data read from the display memory 2 is held in the data latch 3, the segment electrodes of the LCD 1 are further driven via the segment driver 4 and display of any pattern is performed among the common electrodes driven according to the common signal Ci.

As described above, the liquid crystal display control circuit 10A of the first embodiment is provided with the decode section 18 which outputs the selection signal SEL for selecting an output signal of the division section 16 when the count value becomes 1 and the selection section 17 which selects the output signal of the division section 16 according to this selection signal SEL to output a display clock signal DCK. Accordingly, it is possible to set the cycle of the specific common signal (the first common signal in this embodiment) C1 to two times that of each of the other common signals C2 to C33. Thereby, it is possible to extend the driving time of he common electrodes in the LCD. The present embodiment can obtain an advantage that, even in an LCD having different pixel sizes, a difference in display contrast can be made small. Also, the same operation as the conventional apparatus can be performed by setting the operation control signal "XON" to "L".

(Second Embodiment)

Figure 4:
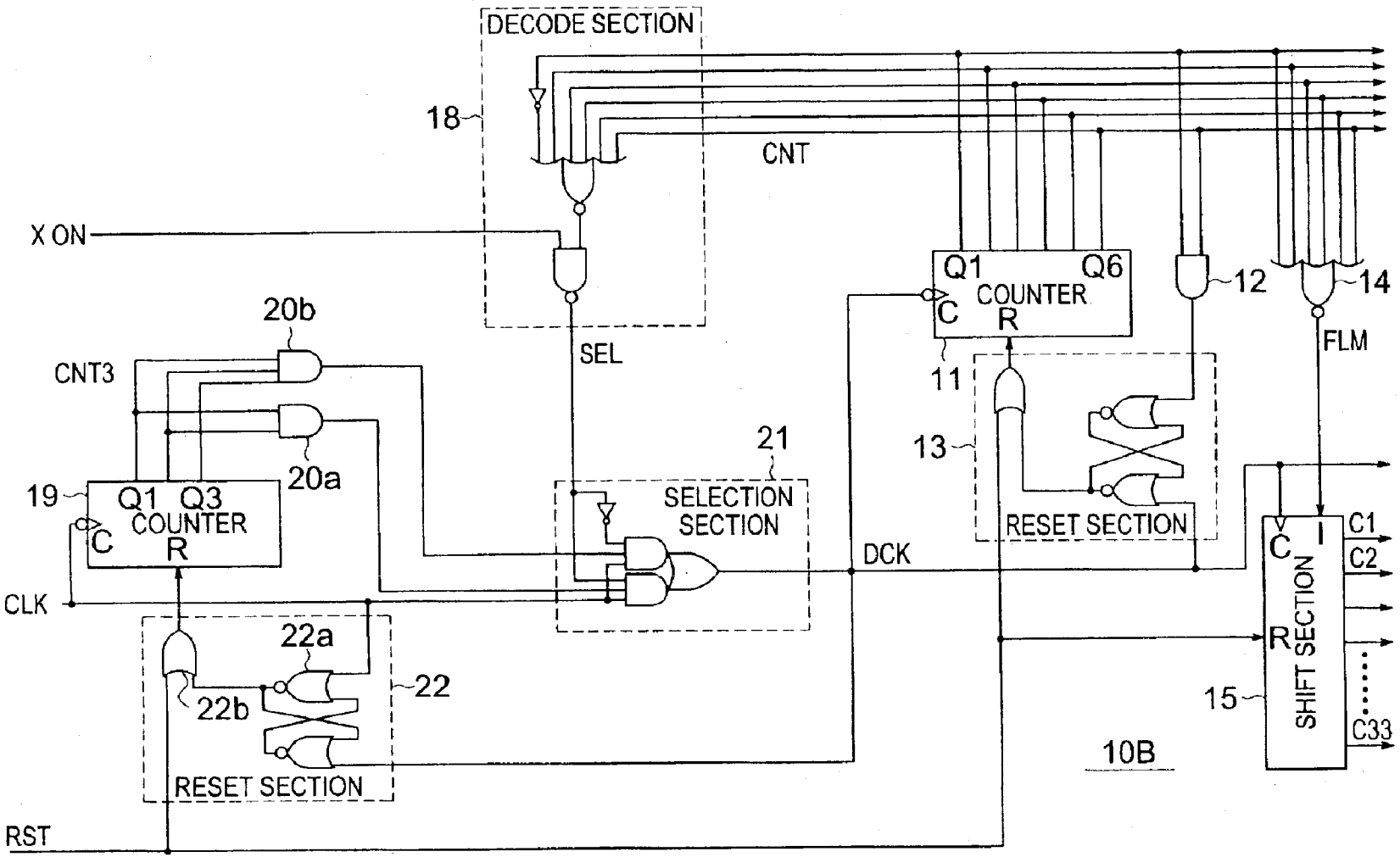
FIG. 4 is a configuration diagram of a liquid crystal display control circuit showing a second embodiment of the present invention.

FIG. 4 is a configuration diagram of a liquid crystal display control circuit showing a second embodiment of the present invention, where common elements or parts to those in FIG. 1 are denoted by common reference numerals.

In a liquid crystal display control circuit 10B, a 3-bit binary counter 19, decode sections 20*a*, 20*b*, a selection section 21 and a reset section 22 are provided instead of the division section 16 and the selection section 17 in FIG. 1.

The counter 19 operates at a timing of falling of a clock signal CLK. The decode sections 20*a*, 20*b* which are respectively constituted by a 2-input AND and a 3-input AND are connected to an output of the counter 19. The decode sections 20*a*, 20*b* output "H" when the count values CNT3 of the counter 19 are 3 and 7, respectively. Outputs of the decode sections 20*a*, 20*b* are connected to the selection section 21.

The selection section 21 selects one of the output signals of the decode sections 20*a*, 20*b* according to "H" or "L" of the selection signal SEL input from the decode sections 18 to output it as a display clock signal DCK.

The reset section 22 is constituted by a SR type FF 22*a* and a two-input OR 22*b*. The FF 22*a* is set by the display clock signal DCK and it is reset by the clock signal CLK. The FF 22*a* is connected at its output to one of inputs of the OR 22*b*. A reset signal RST is applied to the other input of the OR 22*b*. The OR 22*b* is connected at its output to a reset terminal R of the counter 19. The other constitution is similar to that shown in FIG. 1.

Figure 5:
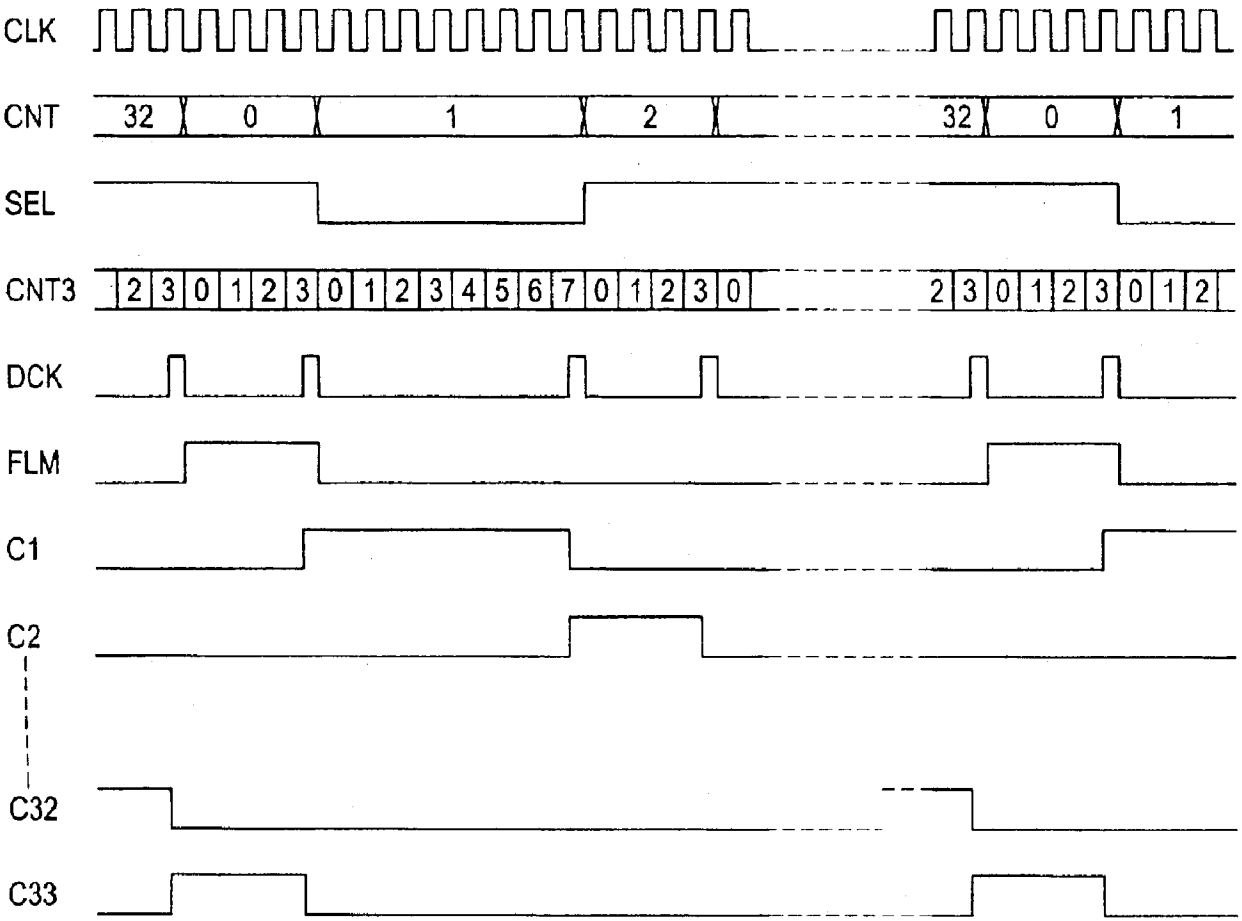
FIG. 5 is a signal waveform diagram showing an operation timing in FIG. 4.

FIG. 5 is a signal waveform diagram showing an operation timing in FIG. 4. An operation of the apparatus in FIG. 4 will be explained below with reference to FIG. 5. Here, it is assumed that the operation control signal XON has been set to "H".

When the count value CNT of the counter 11 is 0, the selection signal SEL outputted from the decode section 18 is "H". Therefore, the output signal of the decode section 20*a* is selected by the selection section 21. The number of the clock signals CLK is counted by the counter 19 at a timing of falling thereof. When the count value CNT 3 of the counter 19 becomes 3, the output signal of the decode section 20*a* becomes "H". Thereby, the display clock signal DCK is outputted by one pulse from the selection section 21 in synchronism with the clock signal CLK.

The display clock signal DCK is inputted into the counter 19 via the reset section 22 so that the counter 19 is reset. Simultaneously, the display clock signal DCK is applied to the counter 11 so that the count value CNT of the counter 11 becomes 1. When the count value CNT becomes 1, the selection signal SEL of the decode section 18 becomes "L"

and the output signal of the decode section 20*b* is selected by the selection section 21. Thereby, at a time when the count value CNT 3 has become 7, the output signal of the decode section 20*b* becomes "H" and the display clock signal DCK is outputted by one pulse from the selection section 21 in synchronism with the clock signal CLK.

The display clock signal DCK is applied to the counter 19 via the reset section 22 so that the counter 19 is reset. Simultaneously, the display clock signal DCK is input into the counter 11, so that the count value CNT becomes 2 and the selection signal SEL becomes "H". Then, the output signal of the decode section 20*a* is selected by the selection section 21, again.

According to such an operation, the pulse width of the common signal C1 positioned at the first row becomes 8 cycles of the clock signal CLK and the pulse width of each of the other common signals C2 to C33 becomes 4 cycles of the clock signal CLK. Incidentally, the selection signal SEL is fixed to "H" by setting the operation control signal XON to "L". Then, all of the common signals C1 to C33 become a pulse width corresponding to 4 cycles of the clock signal CLK.

As described above, the liquid crystal display control circuit 10B of the second embodiment is provided with the counter 19 which counts the number of the clock signals CLK, the decode sections 20*a*, 20*b* which decode the count value CNT3 of the counter 19, and the selection section 21 which selects one of the output signals of the decode sections 20*a*, 20*b* according to the selection signal SEL to output the display clock signal DCK. Thereby, it is made possible to set the pulse widths of the common signal Ci to any ratio by setting the decode sections 20*a*, 20*b*, so that a difference in display contrast in the LCD 1 can be made smaller.

(Third Embodiment)

Figure 6:
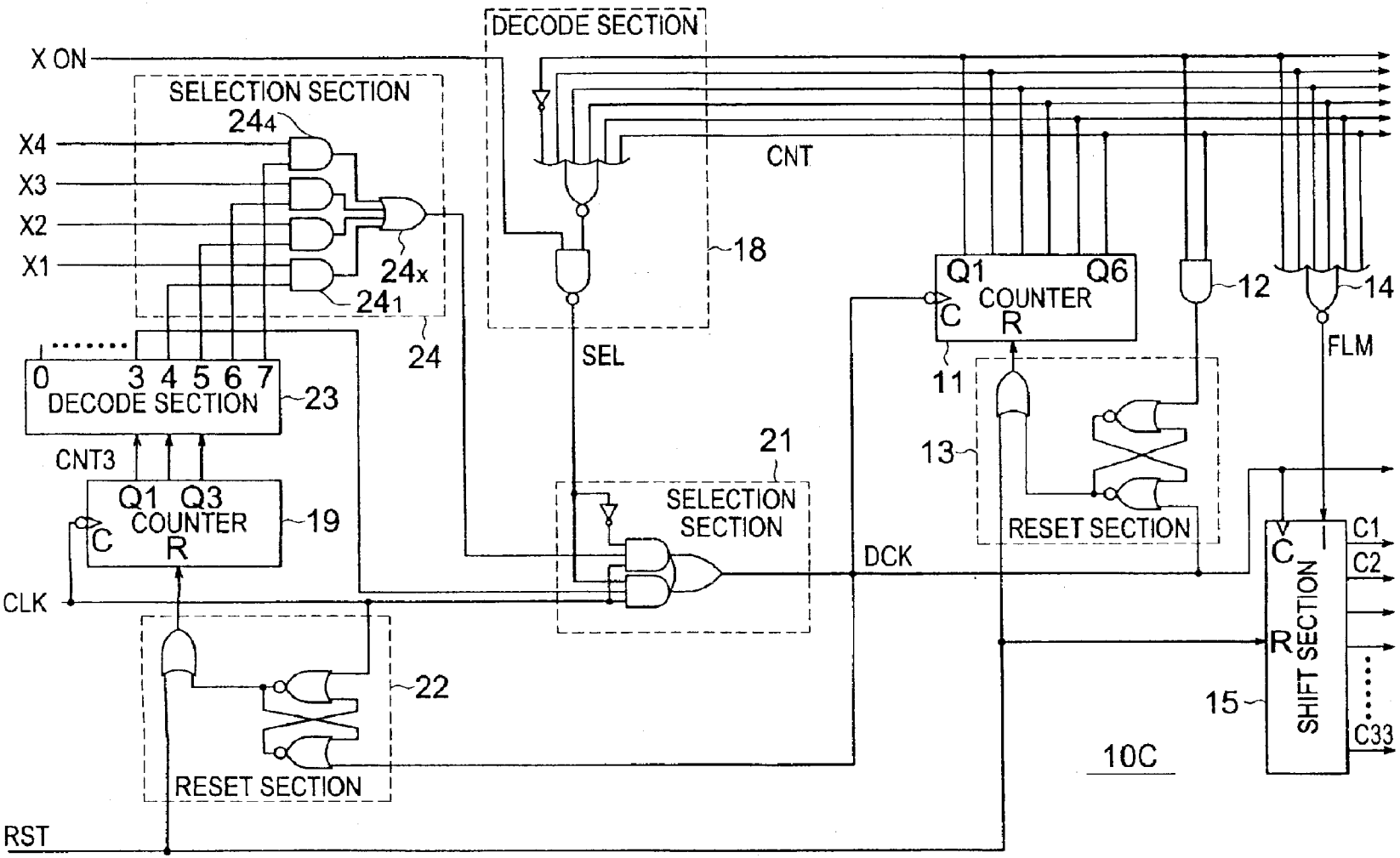
FIG. 6 is a configuration diagram of a liquid crystal display control circuit showing a third embodiment of the present invention.

FIG. 6 is a configuration diagram of a liquid crystal display control circuit showing a third embodiment of the present invention, where common elements or parts to those in FIG. 4 are denoted by common reference numerals.

In a liquid crystal display control circuit 10C, a decoder 23 and a selection section 24 are provided instead of the decode sections 20*a*, 20*b* in FIG. 4.

The decoder 23 decodes the count value CNT3 of the counter 19 to output the output signal corresponding to the value as "H". The output signal corresponding to 3 of the decoder 23 is inputted into the selection section 21, and the output signals of 4 to 7 are inputted into the selection section 24.

The selection section 24 selects the output signals corresponding to 4 to 7 of the decoder 23 according to the selection signals X1 to X4 to output them. Then, the selection section 24 is constituted by two-input ANDs 241 to 244 which are respectively inputted with the selection signals X1 to X4 and an OR 24*x* which performs OR operation of the output signals of the ANDs 241 to 244. Then, an output of the OR 24*x* is connected to the selection section 21. The selection section 21 selects the output signal corresponding to 3 of the decoder 23 when the selection signal SEL is "H", while it selects the signal outputted from the selection section 24 when the selection signal SEL is "L". The output signal of the selection section 21 is inputted into the counter 11 as a display clock signal DCK. The other configuration in this embodiment is similar to that in FIG. 4.

In this liquid crystal display control circuit 10C, the output signals corresponding to 4 to 7 of the decoder 23 can arbitrarily be selected by the selection signals X1 to X4. Thereby, it is made possible to change the pulse width of the common signal C1 more simply as compared with the liquid crystal display control circuit 10B in FIG. 4. Adjustment can be performed so as to further reduce the difference in contrast while viewing the display of the LCD 1.

(Fourth Embodiment)

Figure 7:
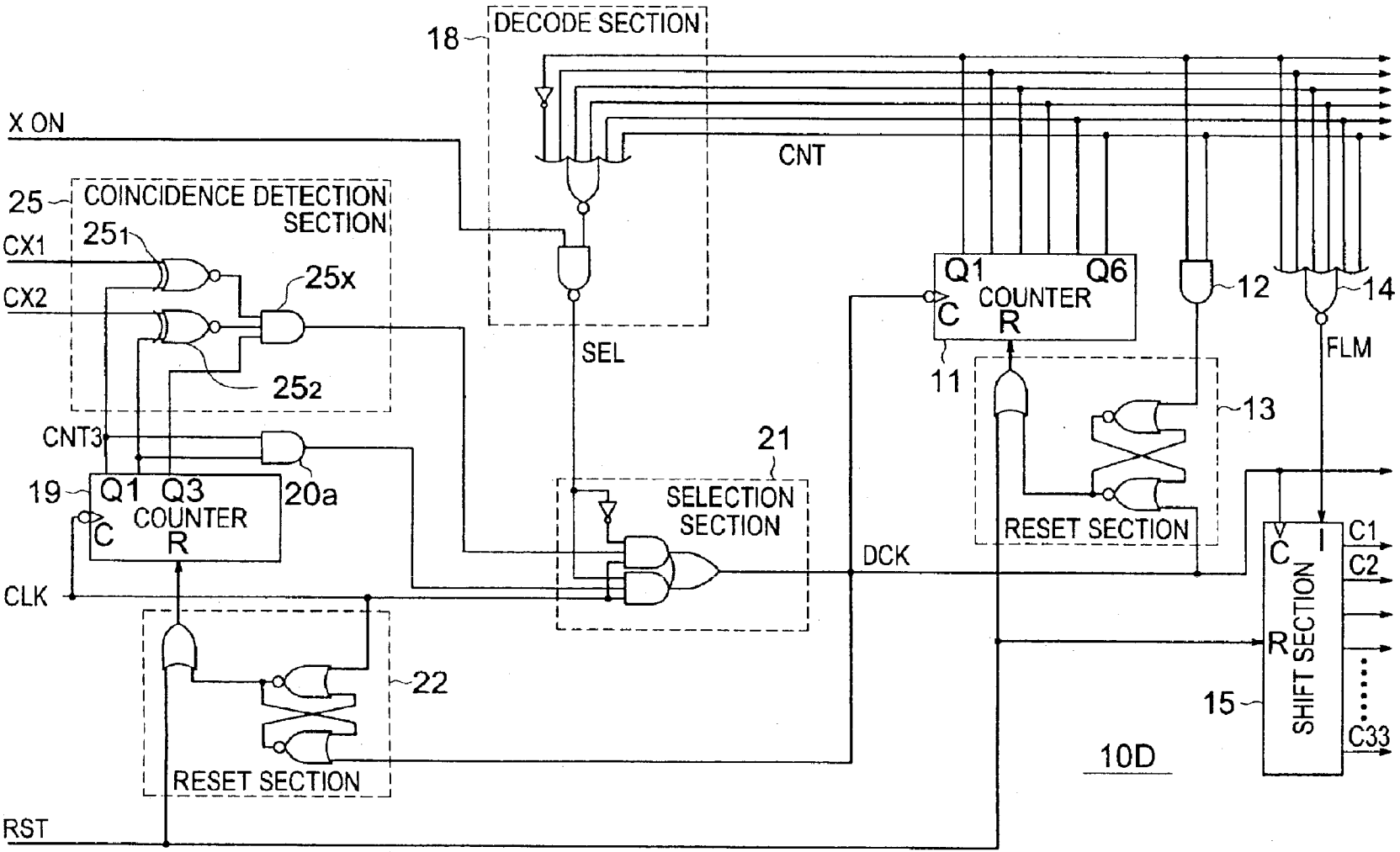
FIG. 7 is a configuration diagram of a liquid crystal display control circuit showing a fourth embodiment of the present invention.

FIG. 7 is a configuration diagram of a liquid crystal display control circuit showing a fourth embodiment of the present invention, where common elements or parts to those in FIG. 4 are denoted by common reference numerals.

In a liquid crystal display control circuit 10D, a coincidence detection section 25 is provided instead of the decode section 20*b* in FIG. 4.

The coincidence detection section 25 compares the count value CNT3 of the counter 19 and set signals CX1, CX2 with each other and it outputs a signal of "H" when these values correspond to each other. The coincidence detection section 25 is constituted by ENORs (ENOR gates) 251, 252 which compare the set signals CX1, CX2 with a signal outputted from the counter 19 for each bit and an AND 25*x* which performs AND operation of the output signals of the ENORs 251, 252. An output of the AND 25*x* is connected to the selection signal 21. The selection section 21 selects the output signal of the decode section 20*a* when the selection signal SEL is "H". The selection section 21 selects the signal outputted from the coincidence detection section 25 when the selection signal SEL is "L". The other configuration is similar to that in FIG. 4.

In the liquid crystal display control circuit 10D, an output signal corresponding to any value of the count value CNT3 can be selected by the set signals CX1, CX2. Thereby, it is made possible to change the pulse widths of the common signal C1 more simply as compared with the liquid crystal display control circuit 10B in FIG. 4. The difference in contrast can further be reduced while viewing the actual display of the LCD1. Also, since any value of the count value CNT3 can be selected by the binary set signals CX1, CX2, the number of signal lines for selection can be reduced as compared with the liquid crystal display control circuit 10C in FIG. 6.

(Fifth Embodiment)

Figure 8:
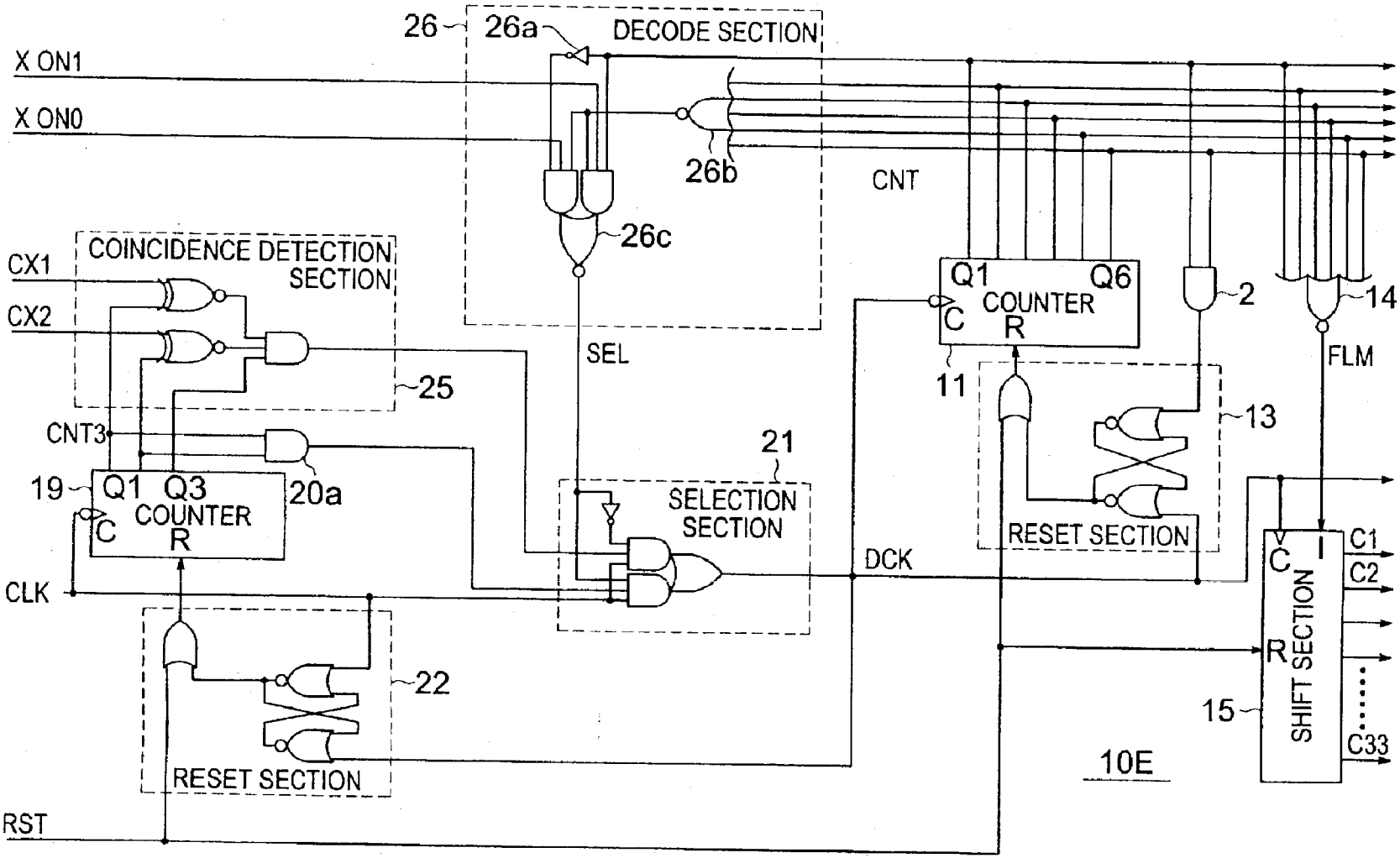
FIG. 8 is a configuration diagram of a liquid crystal display control circuit showing a fifth embodiment of the present invention.

FIG. 8 is a configuration diagram of a liquid crystal display control circuit showing a fifth embodiment of the present invention, where common elements or parts to those in FIG. 7 are denoted by common reference numerals.

A liquid crystal display control circuit 10E is provided with a decode section 26 having a function slightly different from that of the decode section 18 in FIG. 7 instead thereof.

The decode section 26 is constituted by, for example, an inverter 26*a*, a NOR 26*b* and a complex gate 26*c*. A selection signal SEL is outputted according to count values CNT and operation control signals XON0, XON1.

In the decode section 26, in case that the operation control signal XON0 has been set to "H", the selection signal SEL of "L" is outputted when the count value CNT is 0. When the count values CNT are values other than 0, the selection signal SEL of "H" is outputted. Also, in case that the operation control signal XON1 has been set to "H", when the count values CNT are 1, the selection signal SEL of "L" is outputted. When the count values CNT are values other than 1, the selection signal SEL of "H" is outputted. Also, in case that both of the operation control signals XON0, XON1 have been set to "H", when the count value CNT is 0 or 1, the selection signal SEL of "L" is outputted. When both of the operation control signals XON0, XON1 have been set to "L", the selection signal SEL is always "H". The other configuration in this embodiment is similar to that shown in FIG. 7.

In the liquid crystal display control circuit 10E, in case that the operation control signal XON0 has been set to "H", when the count value CNT is 0, the selection signal SEL becomes "L". Then, the output signal of the coincidence detection section 25 is selected by the selection section 21. Thereby, the pulse width of the common signal C33 corresponding to 0 of the count values CNT is coincident with the length set by the set signals CX1, CX2.

On the other hand, in case that the operation control signal XON1 is set to "H", the selection signal SEL becomes "L" when the count value CNT is 0, so that the output signal of the coincidence detection section 25 is selected by the selection section 21. Thereby, the pulse width of the common signal C1 corresponding to 1 of the count value CNT becomes the length set by the set signals CX1, CX2.

As described above, the liquid crystal display control circuit 10E of the fifth embodiment is provided with the decode section 26 which outputs the selection signal SEL of "L" according to the operation control signals XON0, XON1 when the count value CNT is 0 or 1. Thereby, it is made possible to change the pulse width of the first or last common signal. The liquid crystal display control circuit 10E can accommodate a wider range of display patterns corresponding to various kinds of LCDs.

(Sixth Embodiment)

Figure 9:
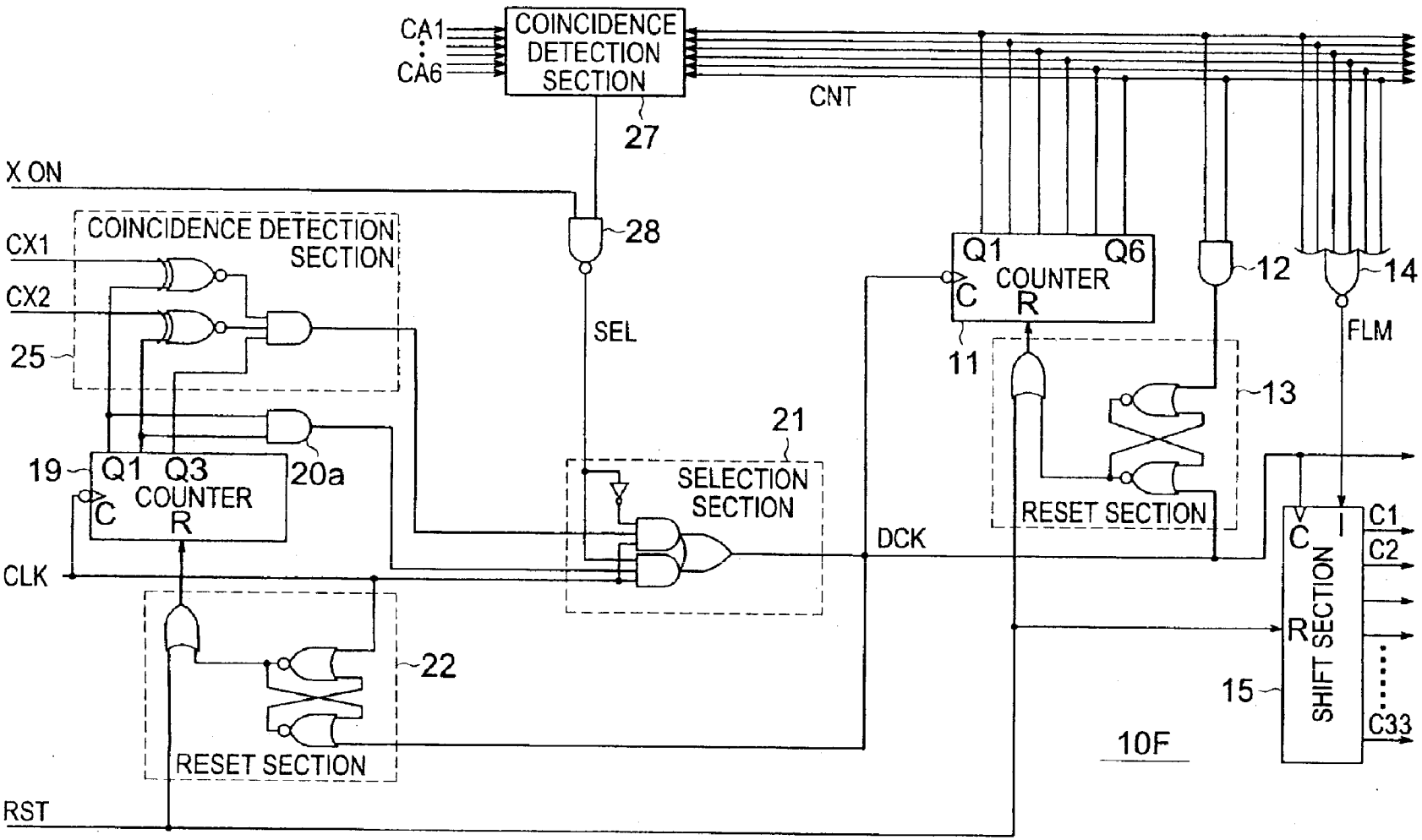
FIG. 9 is a configuration diagram of a liquid crystal display control circuit showing a sixth embodiment of the present invention.

FIG. 9 is a configuration diagram of a liquid crystal display control circuit showing a sixth embodiment of the present invention, where common elements or parts to those in FIG. 7 are denoted by common reference numerals.

A liquid crystal display control circuit 10F is provided with a coincidence detection section 27 and a 2-input NAND 28 instead of the decode section 18 in FIG. 7.

The coincidence detection section 27 compares the count value CNT of the counter 11 and the value set by the set signals CA1 to CA6 with each other. When a coincidence is obtained, the coincidence detection section 27 outputs a signal of "H". The coincidence detection section 27 is constituted by, for example, six ENORs which compare the count value CNT and the set signals CA1 to CA6 with each other for each bit and outputs "H" when a coincidence is obtained, and an AND which performs AND operation of output signals of the six ENORs.

An output of the coincidence detection section 27 is connected to one of inputs of an NAND 28, and an operation control signal XON is inputted into the other input of the NAND 28. A selection signal SEL is outputted from the NAND 28 to be inputted into the selection section 21. The other configuration in this embodiment is similar to that shown in FIG. 7.

In this liquid crystal display control circuit 10F, when the count value CNT is coincident with the value set by the set signals CA1 to CA6, the selection signal SEL of "L" is outputted. Thereby, it is made possible to change the pulse width of any common signal Ci by the set signals CA1 to CA6. Also, it is made possible to prolong the drive term of a corresponding common electrode. Therefore, the liquid crystal display control circuit 10F can accommodate various LCDs.

(Seventh Embodiment)

Figure 10:
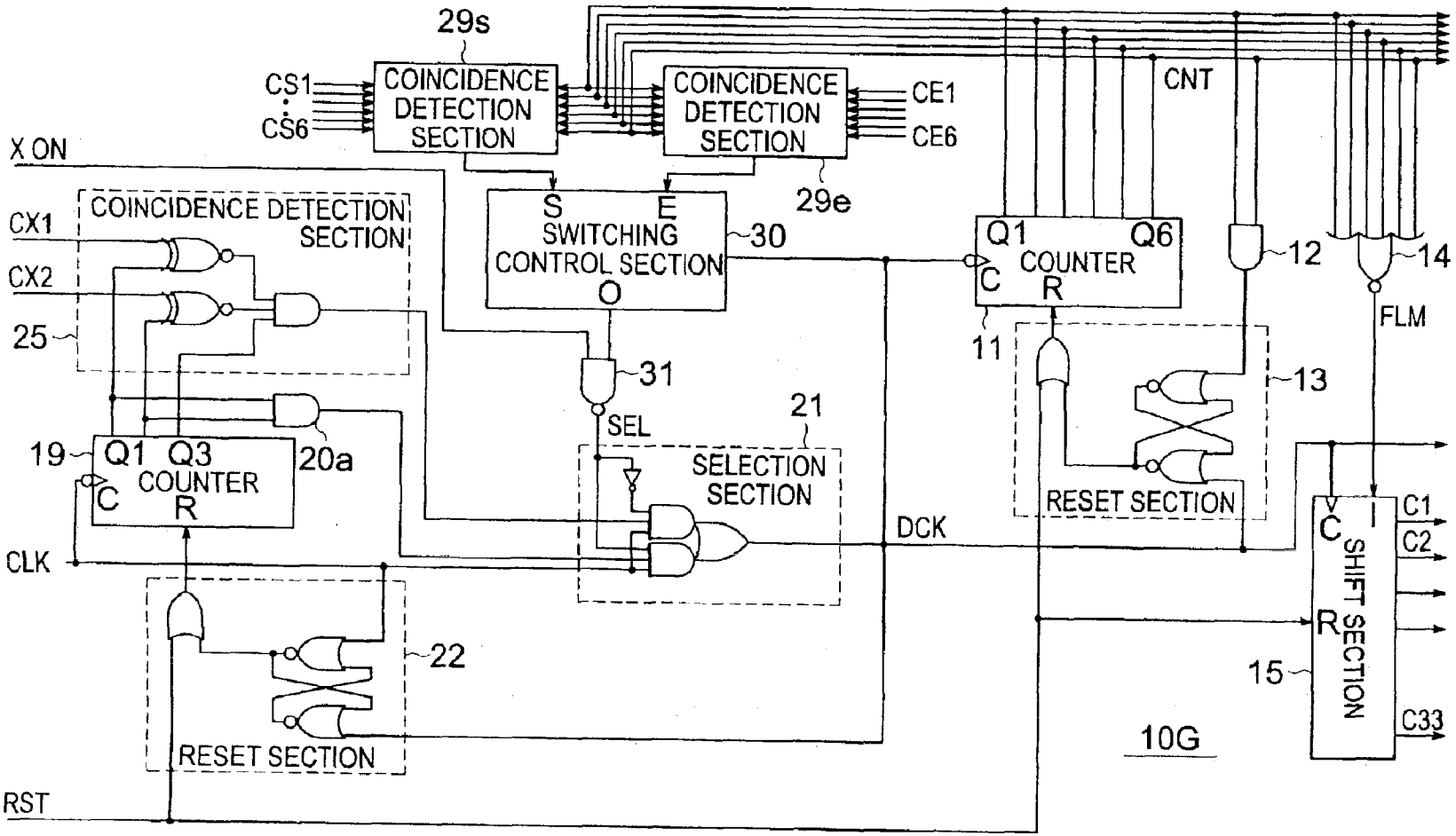
FIG. 10 is a configuration diagram of a liquid crystal display control circuit showing a seventh embodiment of the present invention.

FIG. 10 is a configuration diagram of a liquid crystal display control circuit showing a seventh embodiment of the present invention, where common elements or parts in FIG. 7 are denoted by common reference numerals.

A liquid crystal display control circuit 10G is provided with coincidence detection sections 29*s*, 29*e*, a switching control section 30 and a 2-input NAND 31 instead of the decode section 18 shown in FIG. 7.

The coincidence detection sections 29*s*, 29*e* compare the count value CNT of the counter 11 with respective values of the set signals CS1 to CS6 and CE1 to CE6 with each other and output signals of "H" when a coincidence is obtained. Outputs of the coincidence detection sections 29*s*, 29*e* are respectively connected to input terminals S, E of the switching control section 30.

Figure 11:
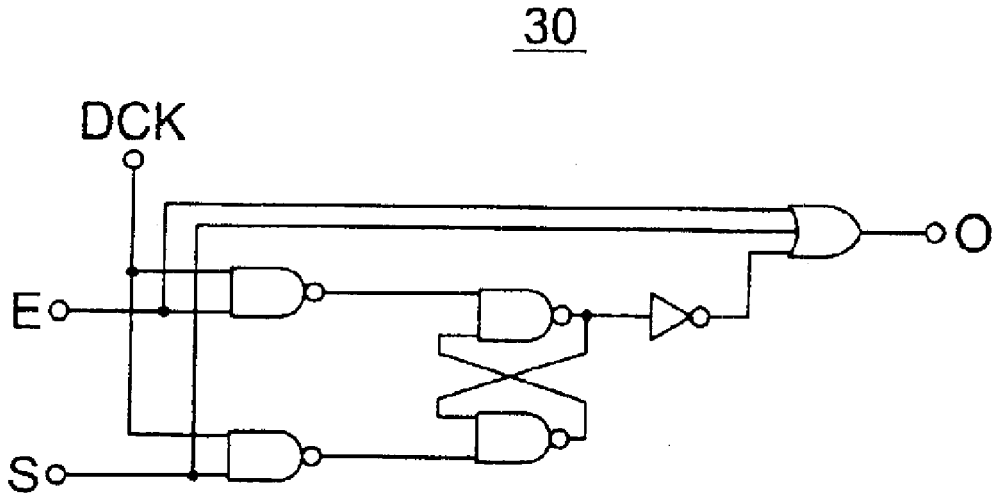
FIG. 11 is a circuit configuration diagram of a switching control section 30 in FIG. 10.

The switching control section 30 has a circuit constitution of a synchronous FF, for example, as shown in FIG. 11. A signal of "H" is outputted from an output terminal O of the switching control section 30 for a term from a time when a signal of "H" is inputted into the input terminal S to a time when a signal of "H" is inputted into the input terminal E. An output of the switching control section 30 is connected to one of inputs of a NAND 31. An operation control signal XON is inputted to the other input of the NAND 31. A selection signal SEL is outputted from the NAND 31 and inputted to the selection section 21. The other constitution in this embodiment is similar to that shown in FIG. 7.

In this liquid crystal display control circuit 10G, the selection signal SEL of "L" is outputted for the term from a time when the count value CNT is coincident with the value set by the set signals CS1 to CS6 to a time when they are coincident with the values set by the set signals CE1 to CE6. Thereby, it is made possible to lengthen the pulse width of the common signals Cs to Ce for any section to prolong the drive term of a corresponding common electrode. The liquid crystal display control circuit 10G can accommodate various LCDs.

Incidentally, the present invention is not limited to the above-described embodiments but it may be modified variously. As modified embodiments, for example, there are the following ones.

(a) The number of the count values CNT of the counter 11 is merely one example. It is necessary to cause the number to coincide with the number of common electrodes in an LCD 1 actually used.

(b) The circuit configurations of the reset sections 13, 22, the selection sections 17, 21, 24, the decode sections 18, 26 and the like are not limited to ones illustrated in the respective figures. These sections may be configured by proper combination of logical gates having similar functions.

(c) In the decode section 21, two divided clock signals which are selected by the selection signal SEL and outputted as the display clock signals DCK are not limited to ones having the described pulse widths. Contrast adjustment can be performed more precisely by increasing the number of bits of the counter 19.

(d) In the first to fourth embodiments, the variations of the circuit for lengthening the pulse width of the common signal C1 have been explained, and in the fifth to seventh embodiments, the variations of the selection circuit of the common signal for lengthening the pulse width have been explained. Accordingly, an optimal circuit can be configured according to a requirement specification by combining the circuits of the first to fourth embodiments and the circuits of the fifth to seventh embodiments.

What is claimed is:

1. A display control circuit for a liquid crystal display which comprises a plurality of common electrodes and a plurality of segment electrodes arranged so as to cross the common electrodes, for performing displaying according to common signals applied to the common electrodes and signals applied to the segment electrodes, comprising:

dividing circuit which divides a clock signal of a constant cycle to generate divided clock signals;

selecting circuit which selects one of the clock signal and the divided clock signal according to a selection signal to output the selected one as a display clock signal;

counting circuit which counts the number of pulses of the display clock signal to output count values in a predetermined range sequentially and repeatedly;

decoding circuit which outputs a selection signal for causing the selecting circuit to select the divided clock signal when the count value has reached a preset value; and common signal generating circuit which generates common signals to sequentially drive common electrodes according to the display clock signal.

2. A display control circuit for a liquid crystal display according to claim 1, wherein the decoding circuit is constituted so as to output the selection signal for causing the selecting circuit to select the divided clock signal when the count value has become a value of a plurality of preset values which is designated by an operation control signal.

3. A display control circuit for a liquid crystal display according to claim 1, wherein the decoding circuit is constituted so as to output the selection signal for causing the selecting circuit to the divided clock signal while the count value is put between preset two values.

4. A display control circuit for a liquid crystal display according to claim 1, wherein the dividing circuit is constituted so as to be capable of selecting a division ratio of the clock signal according to a control signal.

5. A display control circuit for a liquid crystal display according to claim 1, wherein the dividing circuit comprises a counting section which counts the number of pulses of the clock signal to output a binary value.

6. A display control circuit for a liquid crystal display according to claim 1, wherein the dividing circuit comprises:

a counting section which counts the number of pulses of the clock signal to output a binary value;

a decoding section which decodes the binary value to output a signal corresponding to each value; and a selecting section which selects a signal of the decoded result in the decoding section on the basis of the control signal to output the divided clock signal.

7. A display control circuit for a liquid crystal display according to claim 1, wherein the dividing circuit comprises:

a counting section which counts the number of pulses of the clock signal to output a binary value; and a coincidence detection section which compares the binary value and the control signal with each other and outputs the divided clock signal when a coincidence therebetween is obtained.

8. A display control circuit for a liquid crystal display according to claim 1, wherein the pulse width of the common signal can be set at any ratio.

9. A display control circuit for a liquid crystal display according to claim 1, wherein a contrast can be adjusted while viewing displaying of the liquid crystal display.

10. A display control circuit for a liquid crystal display according to claim 1, wherein the display control circuit can accommodate plural kinds of display patterns of the liquid crystal display.

11. A display control circuit for a liquid crystal display which comprises a plurality of common electrodes and a plurality of segment electrodes arranged so as to cross the common electrodes, for performing displaying according to common signals applied to the common electrodes and signals applied to the segment electrodes, comprising:

dividing circuit which divides a clock signal of a constant cycle to generate first and second divided clock signals;

selecting circuit which selects one of the first and second divided clock signals according to a selection signal to output the selected one as a display clock signal;

counting circuit which counts the number of pulses of the display clock signal to output count values in a predetermined range sequentially and repeatedly;

decoding circuit which outputs a selection signal for causing the selecting circuit to select the second divided clock signal when the count value has reached a preset value; and common signal generating circuit which generates common signals to sequentially drive common electrodes according to the display clock signal.

12. A display control circuit for a liquid crystal display according to claim 11, wherein the decoding circuit is constituted so as to output the selection signal for causing the selecting circuit to select the divided clock signal when the count value has become a value of a plurality of preset values which is designated by an operation control signal.

13. A display control circuit for a liquid crystal display according to claim 11, wherein the decoding circuit is constituted so as to output the selection signal for causing the selecting circuit to the divided clock signal while the count value is put between preset two values.

14. A display control circuit for a liquid crystal display according to claim 11, wherein the dividing circuit is constituted so as to be capable of selecting a division ratio of the clock signal according to a control signal.

15. A display control circuit for a liquid crystal display according to claim 11, wherein the dividing circuit comprises a counting section which counts the number of pulses of the clock signal to output a binary value.

16. A display control circuit for a liquid crystal display according to claim 11, wherein the dividing circuit comprises:

a counting section which counts the number of pulses of the clock signal to output a binary value;

a decoding section which decodes the binary value to output a signal corresponding to each value; and a selecting section which selects a signal of the decoded result in the decoding section on the basis of the control signal to output the divided clock signal.

17. A display control circuit for a liquid crystal display according to claim 11, wherein the dividing circuit comprises:

a counting section which counts the number of pulses of the clock signal to output a binary value; and a coincidence detection section which compares the binary value and the control signal with each other and outputs the divided clock signal when a coincidence therebetween is obtained.

18. A display control circuit for a liquid crystal display according to claim 11, wherein the pulse width of the common signal can be set at any ratio.

19. A display control circuit for a liquid crystal display according to claim 11, wherein a contrast can be adjusted while viewing displaying of the liquid crystal display.

20. A display control circuit for a liquid crystal display according to claim 11, wherein the display control circuit can accommodate plural kinds of display patterns of the liquid crystal display.

* * * * *